US005687914A

United States Patent [19]

Bosio et al.

[11] Patent Number: 5,687,914

[45] Date of Patent: Nov. 18, 1997

[54] SPRINKLER DEFLECTOR

[75] Inventors: Claude P. Bosio, Tarrytown; Thomas F. Wancho, Bronx, both of N.Y.

[73] Assignee: The Reliable Automatic Sprinkler Co., Inc.

[21] Appl. No.: 611,245

[22] Filed: Mar. 5, 1996

[51] Int. Cl.[6] ..... B05B 1/26

[52] U.S. Cl. ..... 239/498; 239/518; 169/37

[58] Field of Search ..... 239/498, 518, 239/521, 522, 524, DIG. 1; 169/37–41

[56] References Cited

U.S. PATENT DOCUMENTS

| | | | |
|---|---|---|---|
| 2,025,063 | 12/1935 | Loepsinger . | |
| 2,101,694 | 12/1937 | Tyden . | |
| 2,135,138 | 11/1938 | Kendall | 239/498 |
| 3,703,993 | 11/1972 | Schreiner | 239/498 X |
| 3,918,645 | 11/1975 | Mohler | 239/498 |
| 4,280,562 | 7/1981 | Glinecke | 169/39 |
| 4,296,815 | 10/1981 | Mears | 169/37 |
| 4,296,816 | 10/1981 | Fischer | 169/37 |
| 4,585,069 | 4/1986 | Whitaker | 169/37 |
| 4,700,893 | 10/1987 | Bugler, III | 239/498 |
| 4,880,063 | 11/1989 | Leininger et al. | 169/37 |
| 4,987,957 | 1/1991 | Galaszewski | 169/37 |

FOREIGN PATENT DOCUMENTS

| | | | |
|---|---|---|---|
| 1106820 | 12/1955 | France | 239/524 |
| 593744 | 2/1978 | U.S.S.R. | 239/498 |
| 969923 | 9/1964 | United Kingdom | 239/498 |

*Primary Examiner*—Lesley D. Morris

*Attorney, Agent, or Firm*—Brumbaugh, Graves, Donohue & Raymond

[57] ABSTRACT

In the representative embodiments described in the specification, a pendent sprinkler has a sprinkler body with an axial passage for fire extinguishing liquid and a pair of frame arms supporting a deflector at a location spaced from the end of the axial passage. In order to distribute fire extinguishing liquid substantially uniformly throughout a protected area, the deflector is provided with pairs of tines having ends which are oppositely inclined with respect to the plane of the central portion of the deflector and which extend upwardly from that plane and has further tines intersected by the plane of the sprinkler arms with end portions which are displaced downwardly from the plane of the central portion of the deflector and are inclined upwardly with respect to that plane.

13 Claims, 2 Drawing Sheets

SPRINKLER DEFLECTOR

BACKGROUND OF THE INVENTION

This invention relates to fire prevention sprinklers for distributing liquid in an environment which is subject to a fire hazard.

Most conventional fire suppression sprinklers consist of a threaded sprinkler body connected to a liquid supply pipe to receive fire extinguishing liquid such as water and having a heat responsive valve blocking a passage in the sprinkler body which is set to open the valve passage when the temperature in the vicinity of the sprinkler exceeds a selected value. In order to distribute the water emerging from the sprinkler passage throughout the area to be protected, the sprinkler includes a deflector supported from the sprinkler body usually by a frame consisting of two arms projecting beyond the sprinkler passage on opposite sides of the path of emerging water. Alternatively, the deflector may be supported from the sprinkler body by sliding pins rather than fixed arms, allowing the deflector to be optimally positioned automatically and concurrently with the operation of the sprinkler, as is required with certain types of concealed sprinklers.

In many cases, the sprinkler deflector consists of a substantially planar disk positioned perpendicular to the sprinkler passage which distributes impinging water radially in the direction parallel to the plane of the disk and formed with radial slots which permit a portion of the impinging water to pass through the disk, i.e., downwardly toward the floor of the protected area when the sprinkler is of the pendent type suspended from a ceiling. The water distribution provided by such deflectors, however, has certain shortcomings. In the first place, the arms of the frame which extend from the sprinkler body to support the deflector interfere with distribution of water in the radial direction beyond those arms. Furthermore, the area of the protected environment throughout which the water is distributed as a result of radial distribution by the deflector is limited because the radially distributed water commences falling downwardly immediately upon leaving the deflector.

Attempts have been made to control the water distribution provided by a sprinkler deflector in various ways. The Mohler U.S. Pat. No. 3,918,645, for example, discloses a planar deflector having peripheral tines extending perpendicularly from the deflector surface toward the sprinkler passage to generate a fine vapor cloud, and in the regions adjacent to the sprinkler frame supporting the deflector, the tines are shaped to direct the dispersed cloud of water vapor around the frame arms which support the deflector toward the region radially outward of the frame arms. The dispersion of water into fine particles produced by this deflector arrangement, however, may reduce the area to which the water is distributed because of air resistance encountered by the fine drops of water.

The Loepsinger U.S. Pat. No. 2,025,063 discloses an upright sprinkler with a deflector having downwardly curved side portions consisting of spaced tongues arranged in the form of a square to distribute water over a substantially square area. The patent to Glinecke U.S. Pat. No. 4,280,562 discloses a pendent sprinkler having a flat planar disk supported from a sprinkler body by a frame and a surrounding ring of radially extending blades which are twisted at their root ends and bent at their free ends to cause impinging water to be separated into large droplets and distributed circumferentially. The Whitaker U.S. Pat. No. 4,585,069 discloses a sprinkler nozzle with a deflector having an elongated central apex portion of arcuate configuration and side portions diverging from opposite sides of the apex, each side portion having tines along the terminal edges to distribute water in a relatively narrow elongated spray pattern.

SUMMARY OF THE INVENTION

Accordingly, it is an object of the present invention to provide a sprinkler arrangement which overcomes the disadvantages of the prior art.

Another object of the invention is to provide a sprinkler arrangement which produces increased and uniform distribution of liquid emerging from a sprinkler body.

These and other objects of the invention are attained by providing a sprinkler having a deflector supported from the sprinkler body by spaced frame arms in which the deflector has a plurality of projecting tines with the ends of adjacent pairs of tines inclined in opposite directions with respect to a plane perpendicular to the axis of the sprinkler body. In one embodiment the sprinkler is a pendent sprinkler having a deflector with one pair of tines which are aligned with the plane of the sprinkler support arms on opposite sides of the sprinkler axis, each tine having an end portion which is displaced from the central plane of the deflector in the direction away from the sprinkler body and other pairs of adjacent tines disposed on opposite sides of the plane of the support arms in which each of the adjacent tines have their ends inclined respectively away from and toward the plane of the sprinkler frame arms. Moreover, with a pendent sprinkler, at least one of the tines in each of those pairs also has its end portion inclined toward the sprinkler body to cause impinging liquid to be deflected in the direction toward the sprinkler body as well as laterally with respect to the plane of the sprinkler frame arms, causing liquid to be deflected upwardly, thereby enlarging the area protected by the sprinkler.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
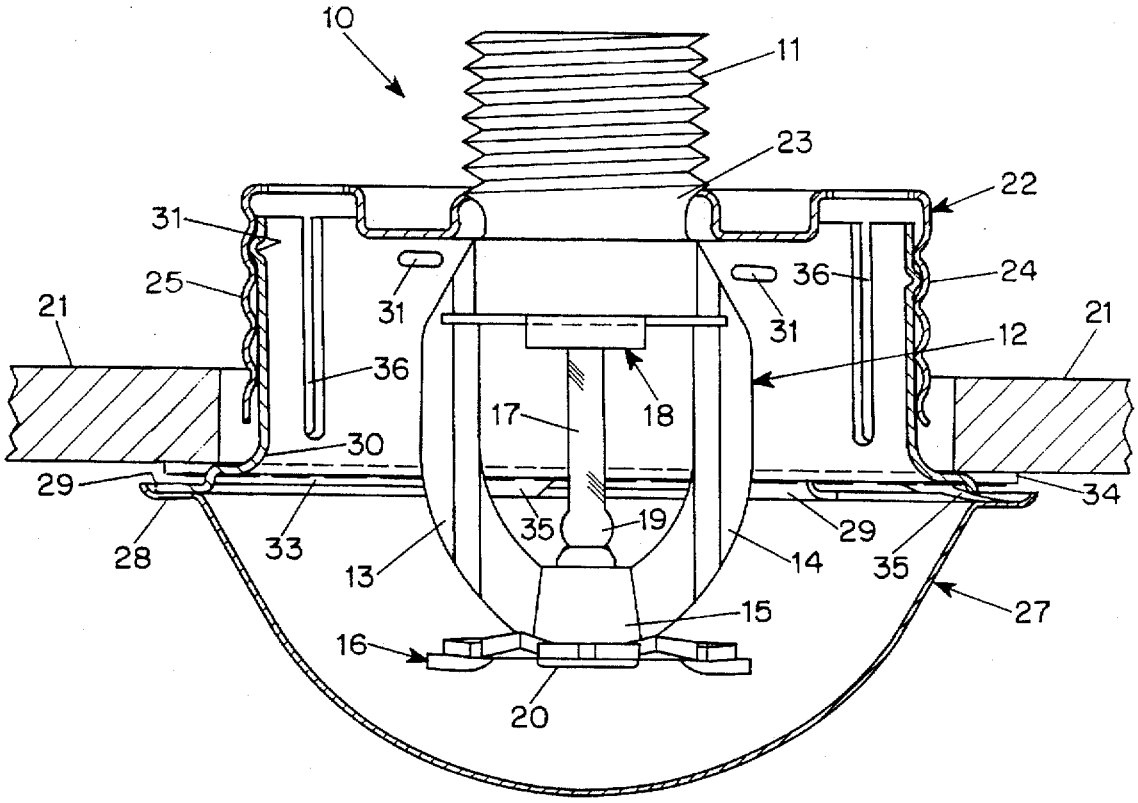
FIG. 1 is a side view, partially in section, illustrating a representative embodiment of a sprinkler arranged in accordance with the invention.

In the typical embodiment of the invention illustrated in FIG. 1, a pendent sprinkler 10 has a body which has a threaded end 11 adapted to be connected to a pipe to supply water or other fire extinguishing fluid and is formed in the usual manner with a central passage (not visible in FIG. 1). At its other end the sprinkler includes a frame 12 consisting of two spaced arms 13 and 14 which are joined in a boss 15 at the end remote from the sprinkler body to support a deflector 16. A thermally responsive element 17, such as a conventional glass bulb containing heat expandable liquid or a conventional fusible solder element, is urged against a plug 18, which normally closes the liquid passage in the valve sprinkler body, by the end 19 of a screw 20 which extends through the boss 15 in the usual manner.

The sprinkler 10 is arranged to be mounted in an opening in a ceiling plate 21 and, in the illustrated embodiment, a cup-shaped cover support 22 is mounted on the neck 23 of the sprinkler body and is formed with a thread 24 in a circumferentially depending portion 25. A generally hemispherical cover member 27 is joined by solder joints 28 to depending tabs 29 of a sleeve 30 which is received within the depending portion 25 and has a plurality of helically arranged projections 31 located and shaped to engage the thread 24 of the peripheral depending portion 25 of the cup-shaped cover support 22, thereby permitting the cover member 27 to be adjustably mounted with respect to the sprinkler by rotation of the sleeve 30 within the depending portion 25. A leaf spring 33 engages a circumferential shoulder 34 on the sleeve 30 and has a plurality of spring fingers 35 urging the rim of the cover member 27 away from the sleeve member 30 as described, for example, in the Leininger et al. U.S. Pat. No. 4,880,063. In addition, the sleeve 30 is formed with longitudinally extending slots 36 separating the sleeve into a plurality of segments which are resiliently biased toward the depending portion 25, permitting the sleeve to be moved axially into position within the cup-shaped support 22, if desired.

The cover member 27 may have a truncated conical shape rather than a hemispherical shape or, if the deflector is supported on sliding pins, a flat cover member may be used. Alternatively, the cover member 27 may be omitted and the sleeve 30 and cover support 22 may be replaced by an escutcheon in which the sprinkler 10 is mounted in a recessed position with the deflector 16 located below the bottom surface of the ceiling plate 21.

When the ambient temperature exceeds a predetermined level, the solder joints 28 fuse, permitting the spring fingers 35 to force the cover away from the sleeve 30 and, when the temperature exceeds the actuation temperature of the temperature responsive element 17, the glass bulb is fragmented, or if a solder element is provided the solder is fused, releasing the plug 18 and permitting liquid to pass through the axial opening in the sprinkler body and impinge the deflector 16. Because the arms 13 and 14 of the frame which supports the deflector 16 interfere with the passage of water toward the deflector and therefore reduce the liquid available for distribution along the plane of the deflector arms 13 and 14, the distribution of the impinging water must be modified to compensate for the reduction in water applied to the deflector 16 in the plane of the support arms 13 and 14.

Figure 2:
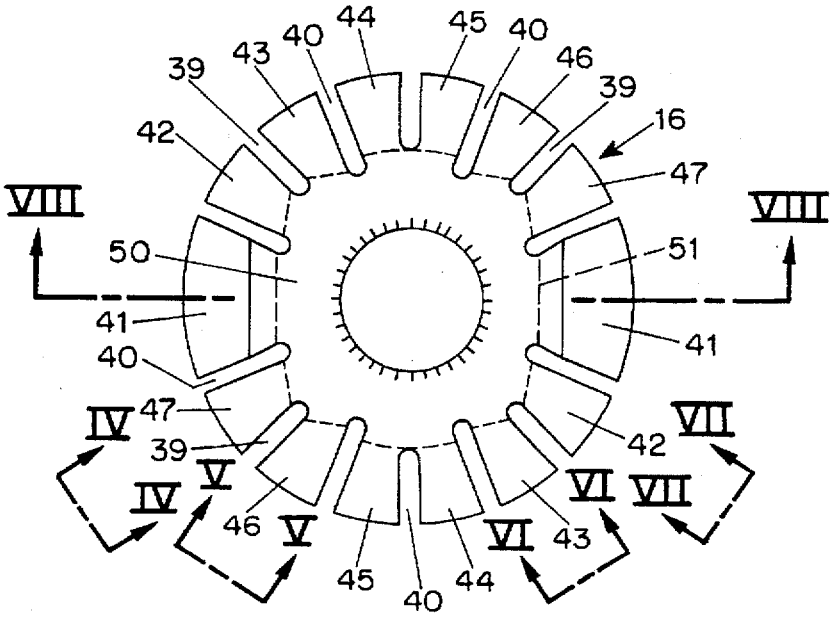
FIG. 2 is a plan view of the deflector shown in the embodiment of the invention illustrated in FIG. 1.
Figure 3:
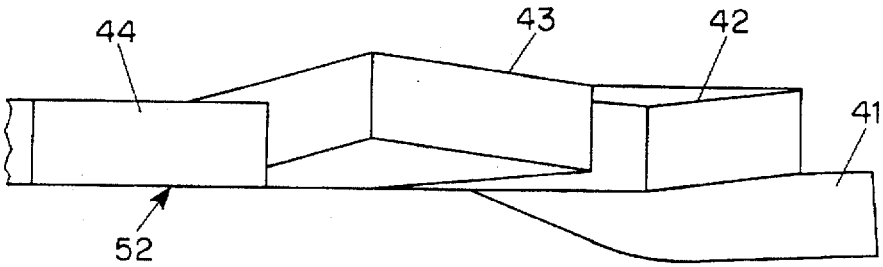
FIG. 3 is an enlarged fragmentary side view showing one quadrant of the deflector shown in FIGS. 1 and 2.

For this purpose, as shown in FIG. 2, the deflector 16 has a periphery formed with a series of substantially radial slots of different lengths 39 and 40 separating the peripheral part of the deflector into an array of spaced tines 41–47. All of the tines are joined to a central portion 50 of the deflector along a dashed line 51, the central portion 50 lying in a plane perpendicular to the axis of the sprinkler body. Since the construction and arrangement of the sets of tines on opposite sides of the plane of the arms 13 and 14 is identical, both sets have the same reference numerals and only one set will be described in detail. Moreover, the tine arrangements on the opposite sides of the plane perpendicular to that plane are mirror images of each other. Accordingly, only the tines 41–44 appearing in the lower right quadrant of the deflector as seen in FIG. 2 are shown in the enlarged side view in FIG. 3 to illustrate the tine configuration provided in each of the four quadrants, the lower left and upper right quadrants being mirror images, respectively, of the lower right and upper left quadrants of FIG. 2. As best seen in FIG. 3, the set of tines in each of these quadrants includes a tine 44 extending perpendicularly to the plane of the frame arms 13 and 14 and lying in the same plane as the central portion 50 of the deflector, the plane of the bottom surface of the central portion being represented by the line 52 in the drawings.

Figure 4:
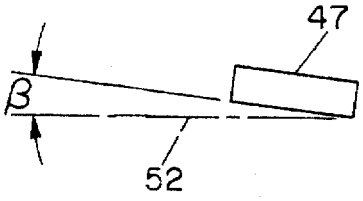
FIG. 4 is a fragmentary side view showing the inclination of one tine of the deflector illustrated in FIG. 2, taken on the line IV—IV of FIG. 2 and looking in the direction of the arrows.
Figure 5:
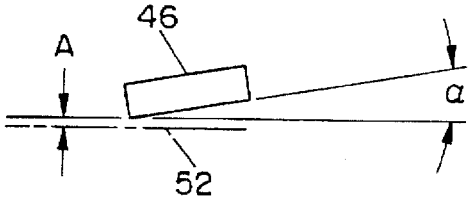
FIG. 5 is a fragmentary side view showing the inclination and displacement of one tine of the deflector illustrated in FIG. 2, taken on the line V—V of FIG. 2 and looking in the direction of the arrows.
Figure 6:
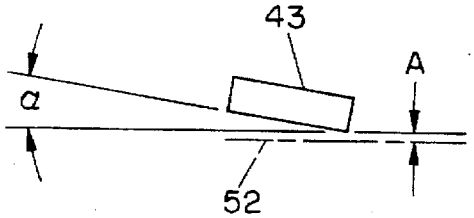
FIG. 6 is a fragmentary side view showing the inclination of one tine of the deflector illustrated in FIG. 2, taken on the line VI—VI of FIG. 2 and looking in the direction of the arrows.
Figure 7:
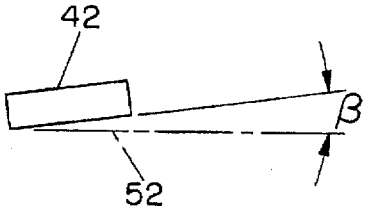
FIG. 7 is a fragmentary side view showing the inclination and displacement of one tine of the deflector illustrated in FIG. 2, taken on the line VII—VII of FIG. 2 and looking in the direction of the arrows.

Each of the tines 41–43, 46 and 47 is bent along the dashed line 51 shown in FIG. 2 away from the lower plane of the central portion 50 of the deflector which is represented in FIGS. 3–8 by a line 52. As shown in FIGS. 3 and 6, the outer end of the tine 43 is bent upwardly with respect to the plane 52 by a distance A and inclined with respect to that plane toward the plane of the frame arms 13 and 14 by an angle $\alpha$ whereas the outer end of the tine 42 has one edge abutting the plane 52 and is inclined upwardly at an angle $\beta$ away from the plane of the frame arms 13 and 14. As shown in FIG. 4, the outer end of the tine 47 has one edge abutting the plane 52 and is also inclined at an angle $\beta$ away from the plane of the frame arms while, as illustrated in FIG. 5, the outer end of the tine 46 has one edge spaced upwardly by a distance A from the plane 52 and is inclined at an angle $\alpha$ toward the plane of the frame arms 13 and 14.

As best seen in FIG. 2 the tines 41 which intersect the plane of the frame arms 13 and 14 are approximately twice as wide as the other tines, each including an angle of approximately 45°. Moreover, as shown in FIG. 8, the tines 41 are bent downwardly from the central region 50 of the deflector along the line 51 and are then bent upwardly by a small angle $\gamma$ with respect to the plane 52 along a line 53, providing an overall distance B between the upper surface of the central portion 50 of the deflector and the lower portion of the tines 41.

Figure 8:
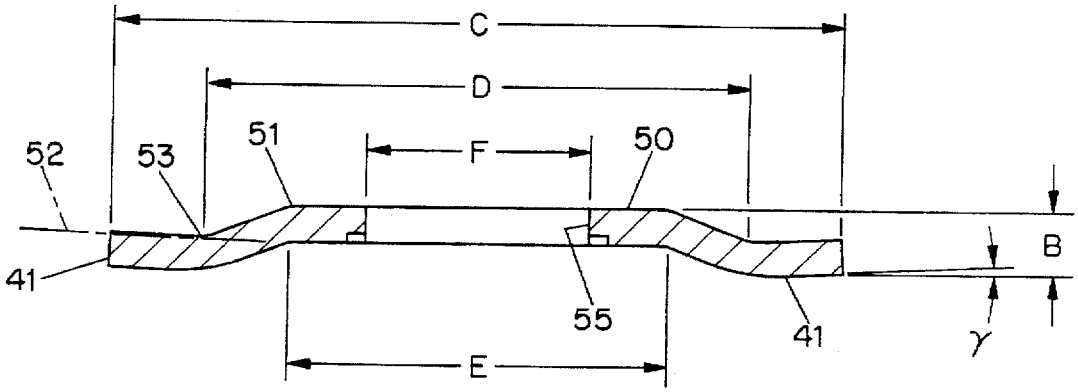
FIG. 8 is a cross-sectional view of the deflector shown in FIG. 2 taken on the line VIII—VIII and looking in the direction of the arrows.

FIG. 8 also illustrates the overall diameter C of the deflector, the dimension D between the lower bend line 53 of the opposite tines 41, the dimension E between the upper bend line 52 of those tines, and the diameter F of the mounting hole 55 by which the deflector is secured to the boss 15 as shown in FIG. 1. Table 1 below sets forth the values for the dimensions and angles shown in FIGS. 4–8 for a representative embodiment of the invention, as well as suitable ranges for those values in deflectors having a thickness of about 0.05 inch (1.27 mm) intended for use in the present invention:

TABLE 1

| Dimension | Value | Range |
|---|---|---|
| A | 0.011 inch (0.28 mm) | 0.0–0.04 inch (0–1.0 mm) |
| B | 0.095 inch (2.41 mm) | 0.08–0.15 inch (2.0–3.8 mm) |
| C | 1.056 inch (26.83 mm) | 0.8–1.3 inch (20.3–33.0 mm) |

TABLE 1-continued

| Dimension | Value | Range |
|---|---|---|
| D | 0.782 inch (19.86 mm) | 0.5–1.0 inch (12.7–25.4 mm) |
| E | 0.565 inch (14.37 mm) | 0.35–0.8 inch (8.9–20.3 mm) |
| F | 0.33 inch (8.38 mm) | 0.2–0.4 inch (5.1–10.2 mm) |
| α | 8.5° | 2–15° |
| β | 6° | 2–15° |
| γ | 2.5° | 0.5–8° |

Using a deflector arrangement in accordance with the invention in which tines adjacent to the plane of the sprinkler frame arms have ends which are alternately inclined toward and away from that plane in the upward direction from the central portion of the deflector, fire extinguishing liquid is distributed more uniformly and over a larger area of a region to be protected than with a conventional planar deflector. Moreover, the provision of larger tines intersecting the plane of the sprinkler frame arms having outer ends which extend below the plane of the central portion of the deflector and are inclined slightly upwardly with respect to that plane also facilitates uniformity and an enlarged distribution area for liquid from the sprinkler by compensating for the shadow effect of the arms interfering with the water distribution.

Although the invention has been described herein with reference to specific embodiments many modifications and variations therein will readily occur to those skilled in the art. Accordingly, all such variations and modifications are included within the intended scope of the invention.

We claim:

1. A sprinkler comprising a sprinkler body having an axial passage for delivery of fire extinguishing fluid, a pair of arms extending from the sprinkler body in a plane parallel to the sprinkler axis, a deflector supported by the pair of arms and disposed in a plane generally perpendicular to the axis of the sprinkler body and having a central portion and a peripheral array of tines separated by substantially radial slots in which at least two tines spaced from the plane of the sprinkler arms and located on the same side of the plane of the sprinkler arms have outer ends inclined at opposite angles with respect to a plane perpendicular to the axis of the sprinkler body.

2. A sprinkler according to claim 1 wherein the deflector includes a pair of opposed tines intersected by the plane containing the sprinkler arms and having end portions which are displaced from the central portion of the deflector in the direction away from the sprinkler body.

3. A sprinkler according to claim 2 wherein the tines intersected by the plane of the sprinkler arm include a larger angle than the other tines of the deflector.

4. A sprinkler according to claim 2 in which the ends of the tines intersected by the plane of the sprinkler arm has outer ends which are inclined in a direction toward the sprinkler body.

5. A sprinkler according to claim 1 wherein the tine of the two tines having inclined ends which is closer to the plane of the sprinkler arms has an outer end inclined in a direction away from the plane of the sprinkler arms.

6. A sprinkler according to claim 1 wherein the tine of two tines having inclined ends which is farther from the plane of the sprinkler arms has an end which is inclined toward the plane of the sprinkler arms.

7. A sprinkler according to claim 6 wherein the tine of the two inclined tines which is farther from the plane of the sprinkler arms has an end which is spaced in the direction toward the sprinkler body from the plane of the central portion of the deflector.

8. A sprinkler according to claim 1 wherein the radial slot between the two tines having inclined ends is shorter than the radial slots separating the two tines having inclined ends from other adjacent tines.

9. A sprinkler according to claim 1 comprising two opposed tines intersecting the plane of the sprinkler arms and two identical sets of tines, one on each side of the plane of the sprinkler arms, each set including two pairs of tines having inclined ends and one pair of tines separating the two pairs of tines having inclined ends.

10. A sprinkler according to claim 9 wherein each pair of tines having inclined ends has one tine with an end inclined at an angle within the range of about 2°–15° from the plane of the central portion of the deflector and another tine with an end inclined at an opposite angle within the range of about 2°–15° from the plane of the central portion.

11. A sprinkler according to claim 9 wherein one of the tines has an inclined end which is displaced from the plane of the central portion of the deflector by a distance within the range of about 0.0–0.04 inch (0–1.0 mm).

12. A sprinkler according to claim 9 wherein the opposed tines intersecting the plane of the sprinkler arms have ends with lower surfaces which are spaced from the plane of the upper surface central portion of the deflector by a distance within the range of about 0.08–0.15 inch (2.0–3.8 mm).

13. A sprinkler according to claim 12 wherein the ends of the opposed tines which intersect the plane of the deflector are inclined toward the sprinkler body by an angle within the range of about 0.5 to 8°.

* * * * *